United States Patent [19]

Revett

[11] Patent Number: 4,552,234

[45] Date of Patent: Nov. 12, 1985

[54] SPIRAL GUN APPARATUS

[75] Inventor: Lowell W. Revett, Youngsville, La.

[73] Assignee: Halliburton Company, Duncan, Okla.

[21] Appl. No.: 585,955

[22] Filed: Mar. 5, 1984

Related U.S. Application Data

[63] Continuation-in-part of Ser. No. 282,555, Jul. 13, 1981, abandoned.

[51] Int. Cl.[4] ..... E21B 43/117

[52] U.S. Cl. ..... 175/4.6; 166/297; 175/4.55

[58] Field of Search ..... 166/297, 299; 175/4.5, 175/4.51, 4.55, 4.57, 4.58, 4.59, 4.6

[56] References Cited

U.S. PATENT DOCUMENTS

| | | | |
|---|---|---|---|
| 2,299,210 | 10/1942 | Calvert | 175/4.55 |
| 2,805,722 | 9/1957 | Morgan et al. | 166/297 |
| 3,346,057 | 10/1967 | Bell | 175/4.6 |
| 3,565,188 | 2/1971 | Hakala | 175/4.6 |
| 3,695,368 | 10/1972 | Lanmon | 175/4.6 X |

OTHER PUBLICATIONS

Welex Spiral Jet Perforator, Feb. 1981, A Halliburton Company Brochure, Houston, Texas, 4 pages.

"Only Lane-Wells Gun Perforator38 , 10/1939, published by Lane-Wells Company, vol. 5, No. 10.

*Primary Examiner*—Stephen J. Novosad
*Assistant Examiner*—Thuy M. Bui
*Attorney, Agent, or Firm*—William J. Beard

[57] ABSTRACT

A perforating gun for use in well bores and having a perforating means disposed in a azimuthal dispersion pattern about a vertical axis where the dispersion is characterized by azimuthal spacing of not less than 15° with respect to each of the perforating means in a gun. The penetration pattern of the perforating means is dispersed longitudinally along the gun and rotatively around the circumference of the gun. The circumferential disposition of the shots can be in clockwise spiral or counterclockwise spiral or in a combination of spirals.

8 Claims, 8 Drawing Figures

SPIRAL GUN APPARATUS

RELATED APPLICATIONS

This application is a continuation-in-part of application Ser. No. 282,555 filed July 13, 1981 and now abandoned.

FIELD OF THE INVENTION

This invention relates to perforating guns for oil and gas wells, and more particularly to a perforating gun design for obtaining effective circumferential penetration of earth formations traversed by well bores.

BACKGROUND OF THE INVENTION

Perforating guns for use in oil and gas wells traversing earth formations are well known. Early development of perforating guns included a bullet gun which shoots a projectile through the well casing, the cement sheath and into the earth formation. The subsequently developed shaped charge perforator generates a high velocity jet of energy which perforates a casing and cement sheath to produce a penetration in the earth formations. Chemical and liquid penetrating devices, as well as mechanical devices, have also been developed for producing perforations into the casing and earth formations. In the advent of modern production techniques, perforating guns which pass through a tubing and are operable in the casing below the end of the tubing also have been developed. In the latter type of gun it is usual to locate the gun to one side of the well bore and, if possible, direct the penetrating jet into the casing adjacent to the gun at a zero phase orientation. Other shaped charge perforating guns typically are oriented to produce penetration at an angle of 90° or 120° from one another and are symmetrically arranged.

While there are many variations of angular phasing of the penetrating devices illustrated in the prior art, there had been no suggestion that the phasing of the directions of penetrating devices can be critical or beneficial. Heretofore, the angular phasing in patents has been a matter of random illustration rather than choice.

THE PRESENT INVENTION

The present invention is concerned with apparatus for use in a borehole for perforating a casing, the surrounding cement sheath and the earth formations in such a manner that: remedial cement operations can be more effectively performed; the possibility of shot pattern overlap is substantially eliminated where repeated perforating is performed; deeper than normal penetration is achieved by some of the perforations when the reservoir rock is under stress loading and thereby also reducing the stress hydraulic pressure to fracture reservoir rock; the probability of intersecting open fractures in the formation is increased; and a radial flow pattern into the wellbore is provided.

These objectives are obtained by a perforating gun having a perforating means disposed in a azimuthal dispersion pattern about a vertical axis where the dispersion is characterized by azimuthal spacing of approximately 15° with respect to each of the perforating means in a gun. In the apparatus of the present invention, the penetration pattern of the perforating means is dispersed longitudinally along the gun and rotatively around the circumference of the gun. The circumferential disposition of the shots can be in clockwise spiral or counterclockwise spiral or in a combination of spirals.

In a preferred embodiment, the first twelve perforating means of twenty-four perforating means in a gun are phased at 30° from one another in a clockwise spiral and the second twelve perforating means are, after a 15° rotation, phased at 30° from one another to form a second clockwise spiral. Other variations contemplated by the invention include utilizing twenty-four perforations over a six foot interval and having twenty-four different directions of shots with a minimum phasing of at least 15° and use of spirals and counterspirals directions in the azimuthal phasing of the penetrations.

IN THE DRAWINGS

In the drawings, the illustrations of the present invention are as follows:

FIG. 1 schematically illustrates a perforating apparatus emboding the present invention and disposed in a cased wellbore;

DESCRIPTION OF THE INVENTION

Figure 1:
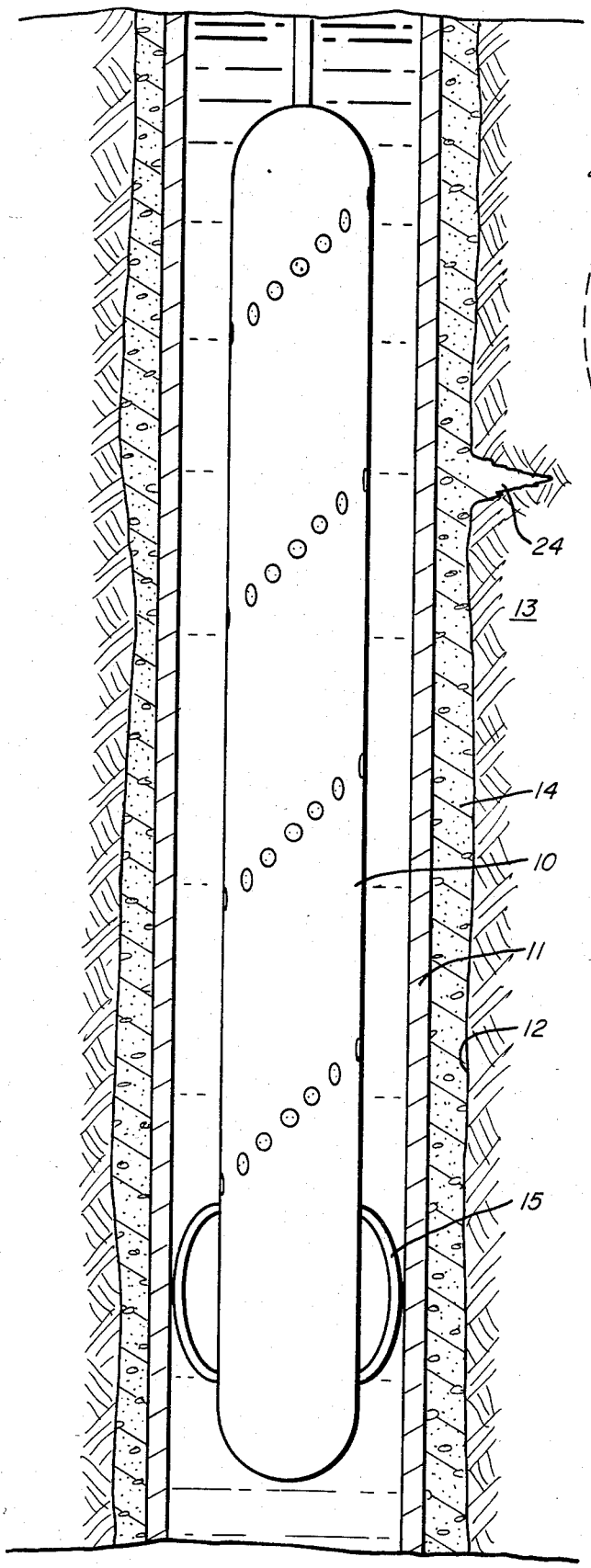

Referring now to FIG. 1, a perforating apparatus 10 is illustrated in schematic form as it would appear in the course of a typical perforating operation in a vertical well casing 11 disposed a wellbore. The wellbore 12 traverses earth formations 13 and the casing 11 is typically filled with a well control liquid such as a mud during the perforating operation. The casing 11 is surrounded by a cement annulus 14 which positions the casing 11 in the wellbore 12 and seals off the wellbore 12 from vertical migration of fluids between the casing and the wellbore. The perforating apparatus 10 is illustrated in a centralized position in the wellbore. Only the lower centralizing apparatus 15 for centrally locating the apparatus in the casing is shown. The centralizers if used, optimize the standoff distance of the perforating apparatus from the well casing so that each of the perforating devices is at a uniform distance relative to the casing. While not illustrated, the perforating apparatus is suspended in the wellbore by means of an armored electrical cable or wireline which can transmit a firing current or control signal to the perforating apparatus and initiate operation of the perforating apparatus in the wellbore from the earth's surface. Typically, initiation of the perforating apparatus is by a blasting cap attached to a primer cord which quickly initiates the operation of the apparatus of the perforating means. The primer cord is a high explosive train such as cyclotrimethylene (RDX) which is detonated by the blasting cap and creates shock wave of greater than 20,000 feet per second is needed to detonate the perforating means. With all of the shaped charges connected to a single length of primer cord, the individual shaped charges are detonated substantially simultaneously. Where the gun size relative to the casing permits, centralizers are not necessary. While this will affect the depth of penetrations somewhat, it is not necessarily critical to the perforating operation.

In one embodiment of the present invention it is contemplated that the type of perforating apparatus would have perforating means over a range of our perforating interval from one and one-half feet to approximately fifteen feet with a perforation density of not more than four perforations per foot. The apparatus is typically sized at three and one-eighth inch, four inch and five inch diameters.

Figure 2:
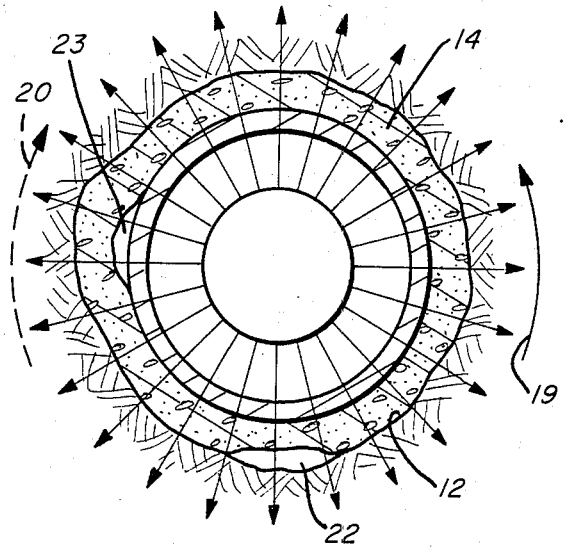
FIG. 2 illustrates in cross section a perforating gun embodying the present invention disposed in a wellbore and indicating schematically the directions of perforations of the gun over a vertical interval of the gun.

As illustrated in FIG. 1, each of the perforating means which produce the perforations are arranged in a spiral disposition about the length of the apparatus and the angular azimuthal phase difference between adjacent perforating means is 15°. Thus, as illustrated in FIG. 2, over an interval of the pipe which is perforated, an effective 360° penetration coverage of the casing is obtained. The 360° coverage is obtained by virtue of 15° angular displacement of the perforating means with respect to the vertical axis of the apparatus. The spiral of the perforating means is illustrated in a clockwise direction by the arrow 19 but may, of course, be in a counterclockwise direction as indicated by the arrow 20. If multiple perforations at the same location or depth in a wellbore are desired by the use of separate apparatus on two trips in the wellbore, then the use of oppositely spiraled perforating apparatus would avoid the possibility of complete overlap of the perforations in 5 the wellbore.

As illustrated in FIG. 2, there can be one or more undesired vertical channels 22 or 23 located in the cement sheath which requires a remedial squeeze cementing operation to plug or prevent the migration of fluid. With the azimuthal spacing of the perforating means apparatus of the present invention, it is almost virtually assured that one of the penetrations will intersect with a vertical channel disposed about a well casing. Thus, in a squeeze cementing type operation the likelihood that the squeeze cement job will be able to plug a vertical channel and prevent migrating fluid is increased. At the same time, when squeeze cementing type operations of this nature are contemplated, the perforating apparatus can be used with a lesser degree of explosive components which is predesigned to produce a penetration only through the cement sheath and so as to not disturb the formations. Thus, there is less likelihood to adversely affect the cement in place by the forces created by the penetration or to adversely affect the formations by the subsequent cementing operation.

Similarly, as shown in FIG. 1, when there is a vertical or near vertical fractured earth formation 24, it is more likely to intersect the fracture by one of the closely spaced penetrations. This is possible because the perforating means are closely spaced in an azimuthal relationship with respect to one another.

When the formations are under stress loading, the possibility of intersecting and penetrating a stress loaded zone is far more assured with the peripheral coverage penetrations provided by the apparatus of the present invention than by the randomly spaced perforating directions.

Figure 3:
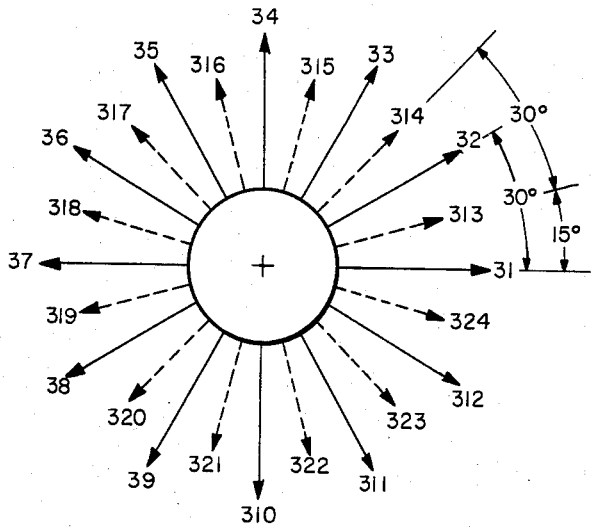
FIG. 3 is a schematic representation of directions of horizontal perforations over a vertical interval of a gun and utilizing a different angular phasings between the directions.

Referring now to FIG. 3, a penetration pattern is indicated in a schematic illustration with respect to horizontal planes of penetration. In FIG. 3, the arrows 31 through 39, 310, 311, and 312 indicate the direction of firing of twelve perforating devices spaced at 30° from one another in a clockwise spiral around the circumference and length of the gun apparatus. The first set of perforating devices is offset with respect to the second set of perforating devices by an angle of 15°. Thus, almost all of the perforations are disposed at 30° with respect to one another over circumferential and vertical interval and yet the circumferential coverage of the perforations is at 15° spacings.

Figure 4:
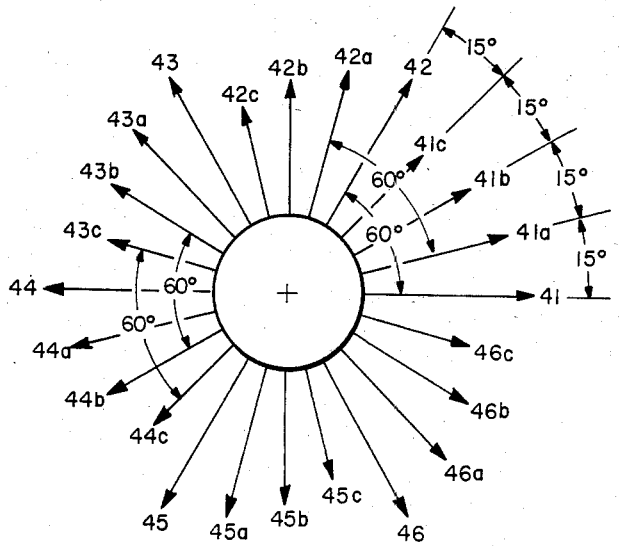
FIG. 4 is a schematic representation of directions of horizontal perforations over a vertical interval of a gun and utilizing different angular phasings of the directions of the perforations.

Referring now to FIG. 4, a penetration pattern along the interval of the earth formations is illustrated in horizontal planes where there are six perforating devices 41–46 disposed in a spiral configuration at 60° azimuthal displacement with respect to one another. A second set of six perforating devices **41*a*–46*a* is disposed in a spiral configuration at azimuthal spacings of 60° with respect to one another with the second set of perforations being offset with respect to the first set of perforating devices by an angle of 15°. A third set of six perforating devices 41*b*–46*b* is separated angularly with respect to one another by 60° in a spiral configuration around the apparatus and are offset with respect to the second set of perforating devices by an angle of 15°. A fourth set of six perforating devices 41*c*–46*b*** is disposed at an angle of 60° with respect to one another in a spiral along the length of the apparatus and are offset with respect to the third set of perforating devices by an angle of 15°. Thus, the effective azimuthal spacing is 15°.

Figure 5:
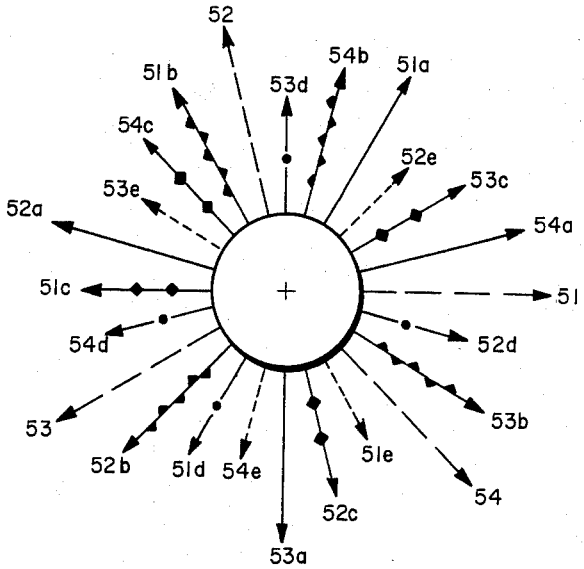
FIG. 5 is a schematic representation of directions of horizontal perforations over a vertical interval of a gun and illustrating still a different arrangement of the directions of perforations.

In the configuration illustrated in FIG. 5 a penetration pattern along an interval of earth formations is illustrated in horizontal planes. In FIG. 5 there are four perforating devices 51–54 in a spiral counterclockwise pattern along the apparatus with the devices separated angularly with respect to one another by angles of 105°. A second set of four perforating devices **51*a*–54*a* is separated from one another by angles of 105° and is illustrated by the numbers of 51*a*–54*a*. A third set of four perforating devices 51*b*–54*b* is displaced by angles of 105° in a counterclockwise spiral around the apparatus as indicated by the arrows. A fourth set of four perforating devices is diposed at angles of 105° with respect to one another as indicated by arrows 51*c*–54*c*. A fifth set of perforating devices is disposed at angles of 105° with respect to the preceding set of perforating devices as indicated by the numbers 51*d*–54*d*, and a final group of four perforating devices is disposed at angles of 105° with respect to the preceding set of perforating devices as indicated by the arrows 51*e*–54*e***. The composite configuration of penetration of the surrounding formations is a circumferential pattern disposed at angular azimuthal dispositions of 15° with respect to one another.

While the effective spacing between the directions of perforations has been defined at 15° it will be appreciated that there is a certain tolerance permissible with respect to this angle which will still permit the objectives of the present invention to be met.

Figure 6:
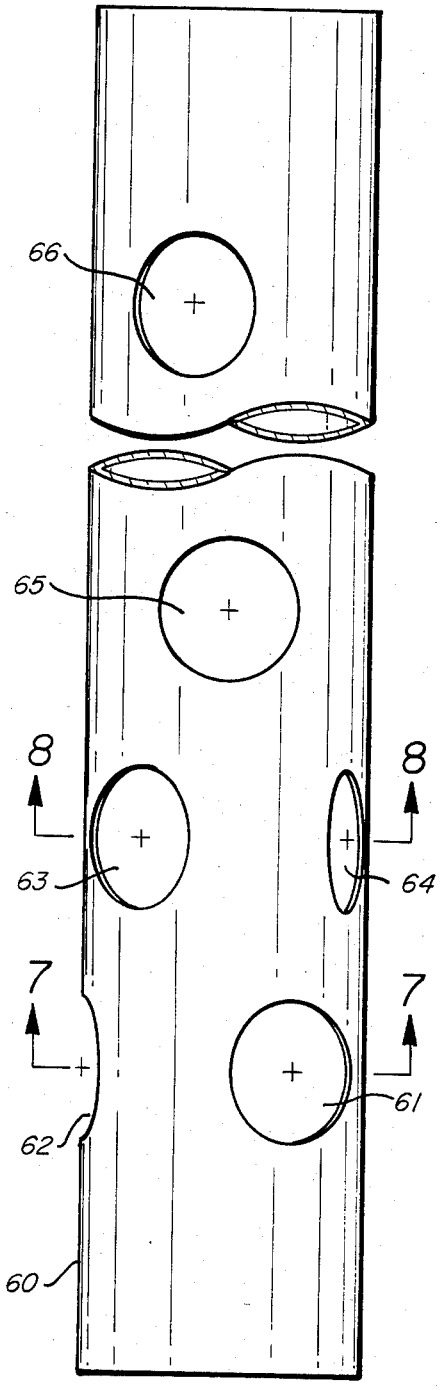
FIG. 6 is a schematic illustration showing a high density perforating gun according to the invention and having three shaped charges in the same horizontal plane with the planes arranged to produce interlocking spirals.

Spiral jet perforating guns have been described which utilizes shaped charge perforating means linearly disposed along the length of the perforating gun and its carrier. The concepts of the present invention, however, are also applicable to perforating guns having a plurality of shaped charge perforating means which are situated in the same transverse plane of the perforating gun and oriented in the symmetrical relationship to each other in the aforementioned transverse planes. Referring now to FIG. 6, for example, a perforating gun is illustrated which has a plurality of firing apertures 61–65 arranged on the outer circumferential surface thereof. In the perforating gun of FIG. 6, three perforating means (not illustrated) are situated in each transverse plane layer of perforating means. The firing apertures of the coplanar perforating means 61–62 are situated at 120° angles from each other about the outer circumference of the body member 60. The firing apertures 61–65 themselves are generally circular in shape and have axes of rotation 67 and 68 FIG. 7 radially disposed with respect to the longitudinal axis 69 of the body member 60. Each plane layer of perforating means are connected by a single length of primer cord of the type previously described. Thus, the entire set of perforating means may be detonated substantially simultaneously by the explosive burning rate of the primer cord.

Figure 8:
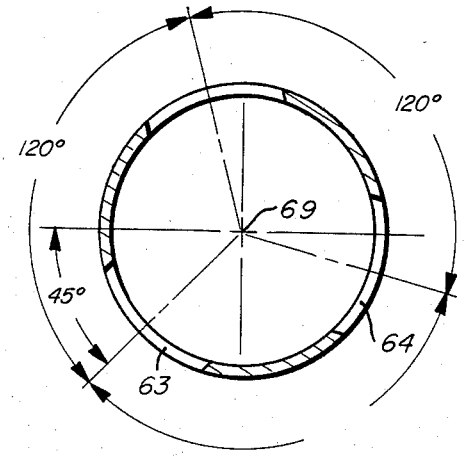
FIG. 8 is a section along 8—8 of FIG. 6.
Figure 7:
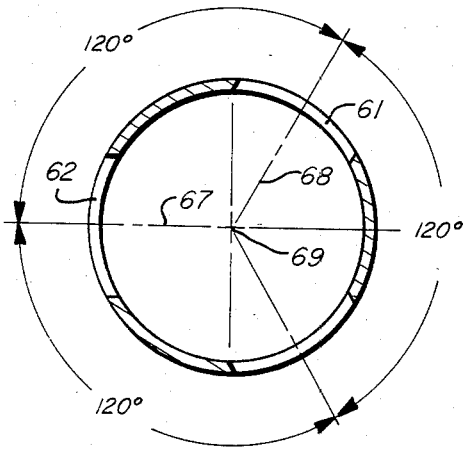
FIG. 7 is a section along line 7—7 of FIG. 6.

FIGS. 7 and 8, are sectional views taken through the center of the firing apertures of different planes of the multiple perforating means disposed longitudinally along the body member of the perforating gun of FIG. 6.

FIG. 7 shows a cross section through the plane of firing apertures 61, 62 and FIG. 8 shows a cross section through the plane of apertures 63, 64. The firing apertures 61, 62 of FIG. 7 are oriented at 45° angles to the next plane of apertures 63, 64 of FIG. 8 in each of the separate transverse plane layers of the perforating means disposed longitudinally along the body member 60 comprising the perforating gun. In the gun of FIG. 6, the plane layers of perforating means are spaced approximately 3 inches apart, thus providing four layers per foot of longitudinal length of the body member 60. Over a two foot longitudinal length of such a perforating gun 24 shaped charges and their firing apertures are provided. The firing apertures comprise three interlocking spirals along the outer circumference of the body member 60. The three interlocking spirals thus provided give complete 360° coverage of the interior of the well casing over the two foot interval comprising twenty-four shaped charges and their firing apertures of the gun. The angular phasing or dispersion between individual perforating means firing apertures over the two foot interval thus becomes 15° as illustrated in FIG. 2.

The type of high density perforating means packing of shaped charge perforating means illustrated in FIGS. 6, 7 and 8 has been found advantageous in particular for the placement of cement in well workover operations. In a copending patent application, Ser. No. 473,832 filed Mar. 9, 1983 and assigned to the Assignee of the present invention, a cement placement technique is disclosed whereby a relatively small volume of cement may be accurately placed in cement channels existing exterior to the well casing in order to shut off water which may be intruding from a water zone above or below a producing hydrocarbon zone. In this technique, it is highly desirable that there be a very high probability of intercepting any cement channels, such as 23 or 22, exterior to the casing as illustrated in FIG. 2. Since the cement channels may generally be very serpentine and crooked in nature over long distances, then can appear relatively straight over a short distance. In order to intercept such channels with a high probability it is necessary to achieve perforation of the casing over a relatively short longitudinal interval without substantially weakening the well casing. Penetrating enough of the interior circumferential surface of the casing in order to virtually assure the interception of randomly disposed cement channels exterior to the casing is required. The very high density packing of perforating means in the manner illustrated in FIGS. 6, 7 and 8 is particularly useful for this accomplishment. As may be readily seen from FIG. 2, for example, the 15° phasing achieving entire circumferential coverage of the interior of the casing over a two foot interval provides such a high probability.

As previously mentioned, centralizers can be used on the exterior of the body member 60 FIG. 6, 10 FIG. 1 of the perforating apparatus of the present invention to achieve approximate concidence of the longitudinal axis of the perforating gun with the longitudinal axis of the casing. If centralizers are used, they optimize the standoff distance or clearance of the firing apertures of the perforating apparatus from the well casing. This allows approximately uniform perforations in size, shape and distribution to be produced in the well casing when the perforating means are fired by detonating the primer cord. The interaction of the spiral pattern of perforating firing apertures on the gun body 60 coupled with the optimum standoff distance or clearance being achieved by centeralization thus, provides very uniform perforations produced in the casing by the firing of the perforating means.

If the diameter of the casing is not greatly in excess of the diameter of the perforating gun apparatus, however, it may not always be necessary to use external centralizer means in order to achieve the optimum standoff condition or clearance. For example, if a 5" diameter perforating gun apparatus is used in a 7" interior diameter casing, then it would probably not be necessary to utilize external centralizers to achieve the coincidence of the gun axis with the casing axis. However, if a 5" diameter or smaller perforating gun were used in 9" interior diameter casing, then the use of external centralizers would be desirable in order to achieve the uniform exit aperture perforations in the casing produced by the perforation means.

While the foregoing descriptions have described particular embodiments of the present invention which are preferred for its operation, it is apparent that changes and modifications to the concepts described herein may be made without departing from the scope of the invention. Accordingly, the aim of the appended claims is to cover the all such changes and modifications as fall within the true spirit and scope of the invention.

I claim:

1. Shaped charge gun perforating apparatus for use in perforating casing in a cased well borehole traversing earth formations comprising:

a hollow longitudinal elongated body member sized and adapted for passage through a cased well borehole and having a longitudinal axis and an outer circumferential surface;

means for maintaining said longitudinal axis of said body member approximately coincident with the longitudinal axis of the casing in a cased well borehole, thereby providing optimum standoff of said outer circumferential surface from the interior surface of the casing;

plural shaped charge perforating guns carried interiorly in said hollow body member and having firing apertures arranged on said outer circumferential surface of said body member and distributed longitudinally along the length of said body member, said firing apertures being generally circular in shape and having axes of rotation radially disposed with respect to said longitudinal axis of said body member, said shaped charge perforating guns being arranged to be substantially simultaneously fired to produce perforations through well casing along the circumference of the well casing, said shaped charge perforating guns being longitudinally distributed in a density of at least four such perforating guns per foot along said body member such that said firing apertures form on said exterior surface thereof a generally longitudinally spirally shaped pattern and wherein the azimuthal angles about said longitudinal axis of said body member formed by said radial axes of said firing apertures with each other are arranged such that over a maximum of a six foot longitudinal length of said body member said radial axes of said firing apertures form approximately 15° angles with respect to each other about said longitudinal axis of said body member, the optimum standoff of said outer circumferential surface and the positioning of said radial axes of said firing apertures cooperatively interacting to provide at least 360° coverage of high azimuthal dispersion perforations produced in the circumference of a well casing over such a maximum of six foot longitudinal length, said perforations being no more than approximately 15° offset from each other over a given length not exceeding six feet.

2. The apparatus of claim 1 wherein said shaped charge perforating guns are disposed longitudinally in said body member such that said firing apertures form a generally continuous spirally shaped pattern in either a clockwise or a counterclockwise direction when viewed from an end of said body member.

3. The apparatus of claim 1 wherein said shaped charge perforating guns includes a first set of perforating guns disposed longitudinally along the length of said body member such that said firing apertures form a generally longitudinally spirally shaped pattern wherein said radial axes of adjacent pairs of said firing apertures form azimuthal angles of approximately 30° with respect to each other and a second set of perforating guns disposed longitudinally along the length of said body member such that said firing apertures form a generally longitudinally spirally shaped pattern wherein said radial axes of adjacent pairs of said firing apertures form azimuthal angles of approximately 30° with respect to each other and wherein said radial axes of said first set of perforating guns firing apertures are offset from said radial axes of said second set of perforating guns firing apertures by an angle of approximately 15°.

4. The apparatus of claim 3 wherein the generally spirally shaped pattern formed by the firing apertures of said first set of perforating guns spirals in the opposite sense from the generally spirally shaped pattern formed by the firing apertures of said second set of perforating guns.

5. The apparatus of claim 1 wherein said perforating guns are disposed longitudinally in said body member, such that said radial axes of said firing apertures of longitudinally adjacent pairs of said perforating guns form an azimuthal angle of approximately 105° with respect to each other.

6. The apparatus of claim 1 wherein said perforating guns include first, second, third and fourth sets of perforating guns disposed longitudinally along said body member such that said radial axes of said firing apertures of adjacent pairs of said guns of each of said first, second, third and fourth sets of guns form azimuthal angles of approximately 60 degrees with respect to each other and disposed wherein said radial axes of each of said sets of perforating guns firing apertures are offset from each other by an azimuthal angle of approximately 15 degrees.

7. The apparatus of claim 6 wherein the generally longitudinally spirally shaped pattern of said firing apertures of said first and third sets of perforating guns spiral in an opposite sense from that of said sense from that of said second and fourth sets.

8. The apparatus of claim 1 wherein said perforating guns include plural perforating guns in the same transverse plane with respect to said longitudinal axis of said body member.

* * * * *